United States Patent [19]

Oberstrass

[11] Patent Number: 4,624,103

[45] Date of Patent: Nov. 25, 1986

[54] BEARING ASSEMBLY FOR YARN FALSE TWISTING APPARATUS

[75] Inventor: Detlev Oberstrass, Tönisheide, Fed. Rep. of Germany

[73] Assignee: Barmag Barmer Maschinenfabrik AG, Remscheid, Fed. Rep. of Germany

[21] Appl. No.: 767,625

[22] Filed: Aug. 20, 1985

Related U.S. Application Data

[60] Division of Ser. No. 459,994, Jan. 21, 1983, Pat. No. 4,545,192, which is a continuation-in-part of Ser. No. 272,940, Jun. 11, 1981, Pat. No. 4,372,106, which is a continuation-in-part of Ser. No. 273,076, Jun. 12, 1981, Pat. No. 4,389,841, which is a continuation-in-part of Ser. No. 429,796, Sep. 30, 1982, Pat. No. 4,481,762.

[30] Foreign Application Priority Data

| | | | |
|---|---|---|---|
| Jun. 14, 1980 | [DE] | Fed. Rep. of Germany | 3022421 |
| Jul. 9, 1980 | [DE] | Fed. Rep. of Germany | 3025921 |
| Dec. 23, 1980 | [DE] | Fed. Rep. of Germany | 3048615 |
| Jun. 5, 1982 | [DE] | Fed. Rep. of Germany | 3221352 |
| Jul. 24, 1982 | [DE] | Fed. Rep. of Germany | 3227711 |
| Sep. 10, 1982 | [DE] | Fed. Rep. of Germany | 3233624 |

[51] Int. Cl.[4] ..... D02G 1/08; D01H 1/241; D01H 7/12; F16C 35/08

[52] U.S. Cl. ..... 57/348; 57/337; 57/339; 57/340; 384/227

[58] Field of Search ..... 57/104, 105, 334–340, 57/348, 349; 384/226–239

[56] References Cited

U.S. PATENT DOCUMENTS

| | | | |
|---|---|---|---|
| 2,523,338 | 9/1950 | Snider | 57/338 |
| 3,029,591 | 4/1962 | Scragg et al. | 57/337 X |
| 3,066,473 | 12/1962 | Maeda | 57/337 |
| 3,225,533 | 12/1965 | Henshaw | 57/340 X |
| 3,820,317 | 6/1974 | Raschle | 57/339 |
| 3,940,914 | 3/1976 | Schuster | 57/339 |
| 4,145,871 | 3/1979 | Iwata et al. | 57/339 X |
| 4,387,557 | 6/1983 | Lorenz | 57/348 X |
| 4,395,873 | 8/1983 | Frys | 57/337 X |
| 4,408,449 | 10/1983 | Bauer et al. | 57/348 X |

*Primary Examiner*—John Petrakes

*Attorney, Agent, or Firm*—Bell, Seltzer, Park & Gibson

[57] ABSTRACT

A yarn false twisting apparatus is disclosed which comprises a pair of rotating circular discs having cooperating friction surfaces for engaging a running yarn at a twisting zone. The drive system for the discs includes a drive component which includes a drive whorl and a coaxial drive pulley, and which is adapted to engage two separate drive belts. The drive component includes a unitary tubular drive member, a central shaft extending through and fixed to the drive member, a sleeve mounted to the frame of the apparatus and extending between the shaft and drive member, and bearings positioned between the shaft and sleeve. Also, the drive component is mounted to the frame by an arrangement which permits adjustment of the rotational axis of the drive whorl about a second axis which perpendicularly intersects the rotational axis, so as to permit accurate alignment of the rotational axis of the whorl along a direction perpendicular to the running direction of the tangential drive belt. The discs are mounted to the frame by a bearing assembly which includes a tubular sleeve which is releasably mounted to the frame, a rotational shaft extending coaxially through the sleeve and mounting the disc at one end, and bearings positioned between the shaft and sleeve.

4 Claims, 7 Drawing Figures

BEARING ASSEMBLY FOR YARN FALSE TWISTING APPARATUS

This is a division of application Ser. No. 459,994, filed Jan. 21, 1983, now U.S. Pat. No. 4,545,192, which in turn is a continuation-in-part of application Ser. Nos. 272,940 filed 6-11-81; 273,076 filed 6-12-81; and 429,796 filed 9-30-82, now U.S. Pat. Nos. 4,372,106; 4,389,841; and 4,481,762, respectively.

The present invention broadly relates to a yarn false twisting machine of the type disclosed in the U.S. Pat. No. Re. 30,159 to Kubler, and more particularly, to the structure of the yarn twisting apparatus of such machine.

As illustrated for example in the above noted Kubler patent, a yarn false twisting machine is designed to subject each of a plurality of running yarns to simultaneous twisting, heat setting, cooling, and untwisting operations, which result in the twist being permanently set into the yarn. Each twisting apparatus of the machine includes rotating twist imparting members having cooperating friction surfaces, and the advancing yarn is guided between the cooperating friction surfaces of the rotating members, whereby the desired twist is imparted to the yarn. The twist imparting members may for example comprise a pair of rotating discs as described in U.S. Pat. No. 4,339,915, or a pair of rotating belts as described in U.S. Pat. No. 4,377,932. In these latter examples, a pressure applying member is also provided which is positioned to bias one twist imparting member toward the other member locally at the twisting zone.

The three above identified parent applications each disclose a drive arrangement for operatively rotating the twist imparting members. Specifically, the illustrated drive apparatus includes a drive whorl rotatably mounted in a whorl support member, means mounting the whorl support member to the frame so that the drive whorl is adapted to be tangentially engaged and rotated by a main drive belt of the apparatus, a drive pulley operatively connected to the drive whorl for concurrent rotation therewith, a belt pulley operatively connected to each of the twist imparting members, an idler pulley mounted to the frame, and a drive belt interconnecting the drive pulley, the two belt pulleys, and the idler pulley.

It is an object of the present invention to provide a drive whorl adapted for use in a yarn false twisting apparatus of the described type, and which is characterized by the ability to withstand the lateral thrust exerted by the tangential drive belt.

It is a more particular object of the present invention to provide a drive whorl component for use in a yarn false twisting apparatus of the described type, and which is adapted for engaging two separate drive belts and for withstanding the lateral thrust exerted by the two belts.

It is another object of the present invention to provide a drive whorl, and a support bracket rotatably mounting the whorl, and which is characterized by the ability to permit the rotational axis of the whorl to be adjustably aligned along a direction perpendicular to the running direction of a tangential drive belt.

It is also an object of the present invention to provide a bearing assembly adapted for rotatably mounting a yarn twist imparting member in a yarn false twisting apparatus of the described type.

These and other objects and advantages of the present invention are achieved in the embodiment illustrated . herein by the provision of a drive component which comprises a unitary tubular drive member composed of a first portion having a cylindrical outer surface and a cylindrical bore, and a second coaxial portion having a cylindrical outer surface and a cylindrical bore. The diameter of the outer surface of the first portion is greater than the diameter of the outer surface of the second portion, and such that the first portion defines a drive whorl and the second portion defines a drive pulley of smaller diameter than the drive whorl. Also, mounting means is provided for rotatably mounting the drive member to a support bracket or the like, and in accordance with the illustrated embodiment of the present invention, this mounting means includes a shaft extending coaxially through the drive member and affixed in the bore of the second portion of the drive member. Further, a sleeve is disposed coaxially between the shaft and the inner surface of the first portion, and bearing means is interposed between the shaft and the sleeve. The sleeve includes a radial shoulder, and an external screw thread is formed on the surface of the sleeve adjacent the shoulder which threadedly mounts a nut. By this arrangement, the sleeve, and thus the drive member, may be releasably mounted in an aperture in a support bracket or the like.

The drive component and support bracket are mounted to a frame member of the machine, with the drive component and support bracket being adjustably pivotable about an axis which perpendicularly intersects the rotational axis of the drive component. Thus it is possible to adjustably align the rotational axis of the drive whorl along a direction perpendicular to the running direction of a tangential drive belt.

The present invention also includes a bearing assembly for rotatably mounting a yarn twist imparting member in a false twisting machine of the described type, and which includes a tubular sleeve which is releasably mounted in an aperture of a support member, a shaft extending coaxially through the sleeve and including an end disposed axially beyond the sleeve, means for mounting a yarn twist imparting member at the outer end of the shaft, and bearing means positioned between the shaft and sleeve for permitting relative rotation therebetween.

Some of the objects having been stated, other objects and advantages of the present invention will become apparent as the description proceeds, when taken in connection with the accompanying drawings in which.

Figure 1:
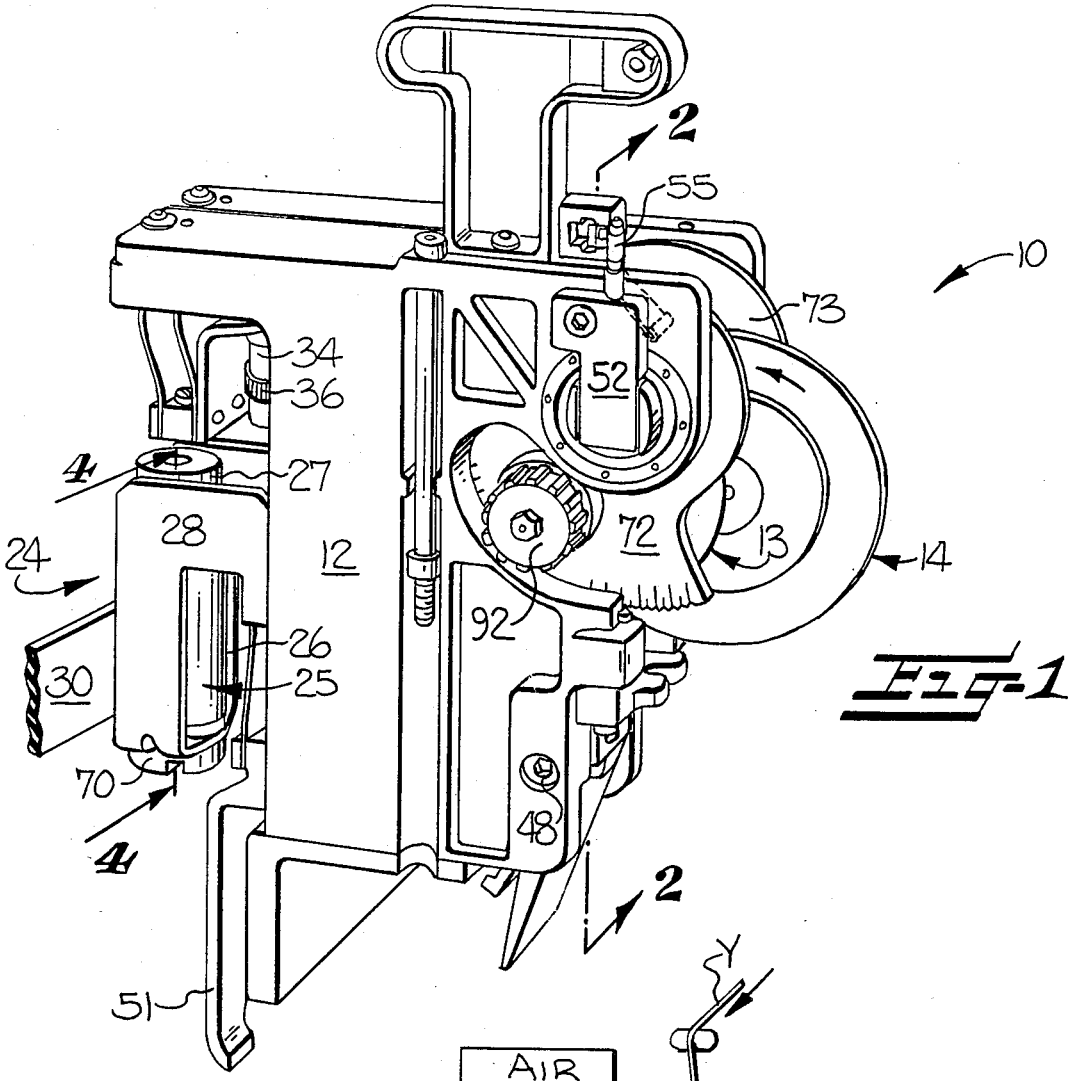
FIG. 1 is a perspective view of a yarn false twisting apparatus which embodies the features of the present invention.
Figure 2:
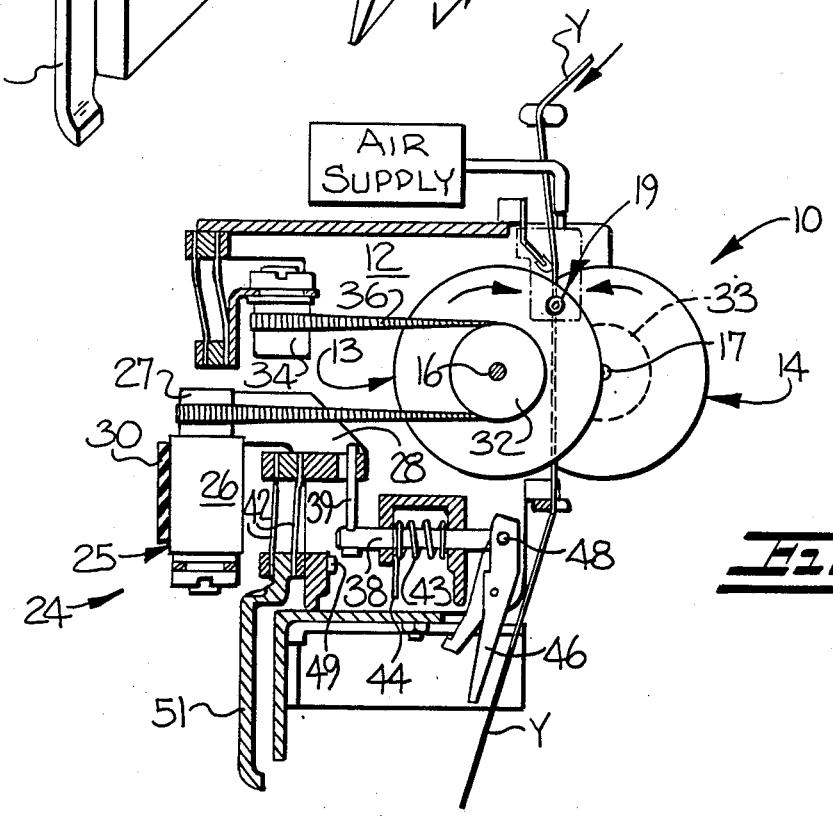
FIG. 2 is a sectional side elevation view of the apparatus, and taken substantially along the line 2—2 of FIG. 1.
Figure 3:
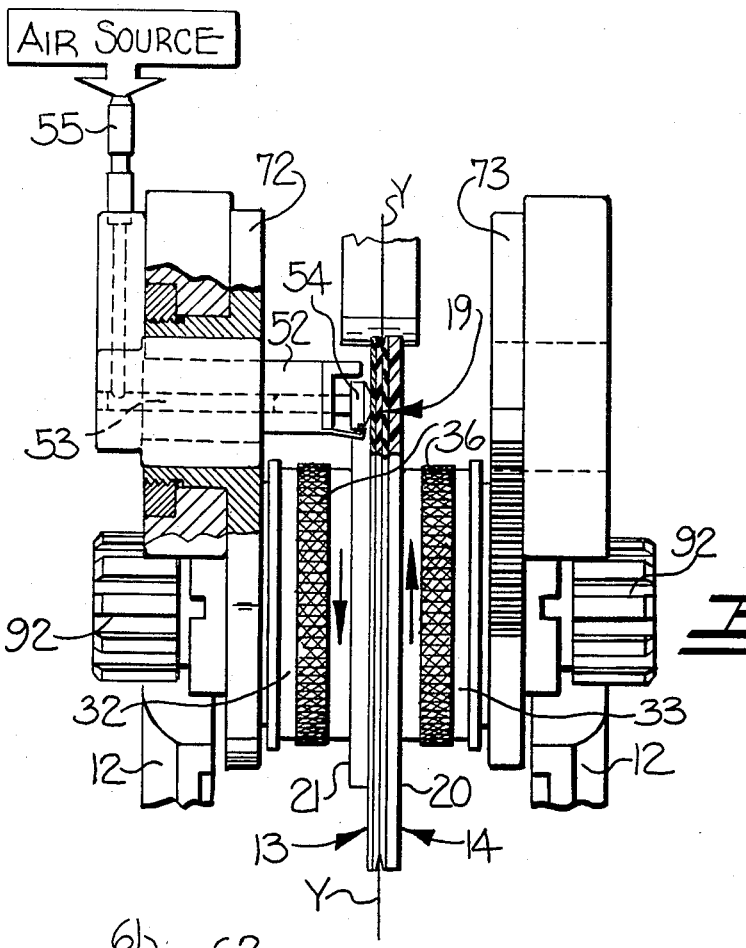
FIG. 3 is a fragmentary front elevation view of the apparatus.

Referring more particularly to the specific embodiment of the invention illustrated in the drawings, there is disclosed a yarn false twisting apparatus 10 which comprises a frame 12 which operatively mounts a pair of twist imparting members in the form of circular discs 13 and 14. The discs 13 and 14 are each relatively thin and flexible, and each includes an elastomeric yarn engaging friction surface on one face thereof. The discs are rotatably mounted on generally parallel shafts 16 and 17, respectively, and such that the friction surfaces are disposed in opposing relationship and define a twisting zone at 19 therebetween (note FIG. 2). Suitable yarn guides are mounted upstream and downstream of the discs, whereby a running yarn Y may be guided between the opposed friction surfaces, and specifically through the twisting zone 19, and such that when the discs are rotated in opposite directions as seen in FIG. 2, a twist is imparted to the yarn. As best seen in FIG. 3, a rigid circular back-up plate 20 is mounted on the shaft 17 and is disposed to overlie the full area of the back or outer side of the disc 14, and a back-up plate 21 of smaller diameter is mounted on the shaft 16 and disposed to overlie the back or outer side of the disc 13. The diameter of the plate 21 is such as to not overlie the twisting zone 19.

The discs 13 and 14 are rotated by a drive system which includes a drive component 24, composed of a unitary drive member 25 which defines a drive whorl 26 and a coaxial drive pulley 27. The drive member 25 is rotatably mounted in a whorl support bracket 28, which is movably mounted to the frame of the apparatus in the manner set forth below, and the drive whorl 26 is positioned for engagement by the tangential drive belt 30, which effects rotation thereof. The drive system further includes belt pulleys 32, 33 coaxially connected to the discs 13 and 14, respectively, and an idler pulley 34 fixed to the frame 12. An endless belt 36 operatively interconnects the drive pulley 27, the two belt pulleys 32, 33, and the idler pulley 34 for effecting concurrent rotation thereof with rotation of the drive whorl 26.

The drive component 24 and the support bracket 28 are mounted to the frame 12 by means which permit the drive component to be maintained in one of two operating positions, and such that in one position the drive whorl 26 is adapted to be tangentially engaged by the drive belt 30 of the apparatus as shown in FIG. 2, and in a second position (not shown) the whorl is separated from the belt. This mounting means includes a rod 38 slideably mounted to the frame 12 for movement along a direction perpendicular to the rotational axis of the drive component. A transverse pin 39 is fixed to the rod 38 and extends through an oversized aperture 40 in the bracket 28, whereby axial movement of the rod 38 serves to correspondingly move the support bracket 28 and thus the drive component. A leaf spring 42, in the form of two parallel spring plates, interconnects the support bracket 28 to the frame 12, while permitting limited movement of the bracket in a direction perpendicular to the rotational axis of the drive component. The rod 38 is biased by a helical spring 43 toward the left as seen in FIG. 2 so as to bias the whorl 26 against the belt 30, with the spring 43 being positioned between the removable clip 44 on the rod and the frame 12 of the apparatus.

A control arm 46 is operatively connected to the rod 38, and thus the drive whorl 26, to permit the machine operator to selectively move the whorl between its operative and inoperative positions. More particularly, the arm 46 is pivotally mounted to the frame by a pair of coaxial pins 48, and the rod and arm include cooperating cam surfaces (not shown) whereby upon upward pivotal movement of the arm, the rod will be drawn to the right by the interengagement of the cam surfaces, to thereby result in the whorl 26 being withdrawn from contact with the belt 30. To return the apparatus to its operative position, the operator presses downwardly on the arm so that the arm pivots downwardly to its original position. A further description of the mounting structure for permitting the drive whorl 26 to move between its operative and inoperative positions may be obtained by reference to applicant's U.S. Pat. No. 4,481,762 and applicant's copending application Ser. No. 459,992, now U.S. Pat. No. 4,559,775.

Figure 6:
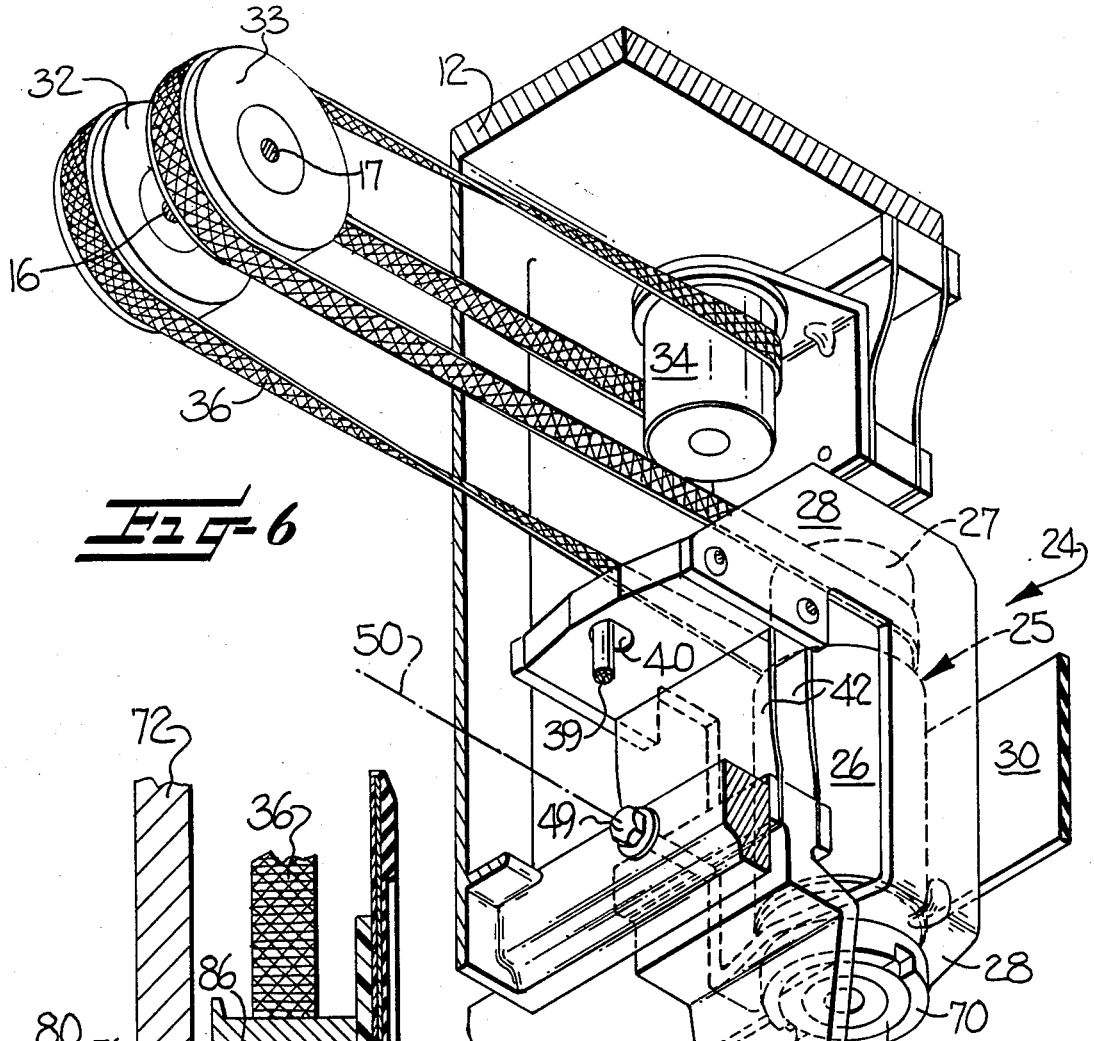
FIG. 6 is a fragmentary perspective view illustrating the drive whorl assembly of the apparatus.

The mounting arrangement for the drive component further includes an assembly for permitting the whorl 26 to be adjustably aligned so that its rotational axis is perpendicular to the running direction of the tangential belt 30, without changing the position of the entire false twisting apparatus or the friction discs 13 and 14. This assembly is best seen in FIG. 6, and includes the support bracket 28, and the leaf spring 42. In addition, the base of the leaf spring 42 includes an aperture for receiving a single mounting bolt 49, which is mounted to the frame of the apparatus along an axis 50 which perpendicularly intersects the rotational axis of the drive whorl 26. An elongate handle 51 is fixed to the base of the leaf spring 42, and extends downwardly in a direction generally parallel to the rotational axis of the drive whorl, and so as to be readily grippable by the machine operator. Thus, the axial alignment of the drive whorl 26 may be adjusted by loosening the bolt 49, manually gripping the handle 51, and rotating the support plate and drive whorl about the axis 50 of the bolt 49. After such adjustment, the bolt is tightened to maintain the desired position of the drive whorl.

As best seen in FIG. 3, the twisting apparatus further includes means for applying a biasing force to the rotating disc at the twisting zone 19. In the illustrated embodiment, this biasing means comprises a mounting receptacle 52 fixed to the frame 12 of the apparatus, the receptacle including a passageway 53 extending through its length. A piston 54 is slideably mounted in the receptacle at the forward end of the passageway, and the piston extends outwardly from the receptacle to define a free end. A nipple 55 is mounted at the other end of the passageway, and is connected to a source of pressurized air, such that the piston is biased into contact with the rotating disc at the twisting zone 19.

Figure 4:
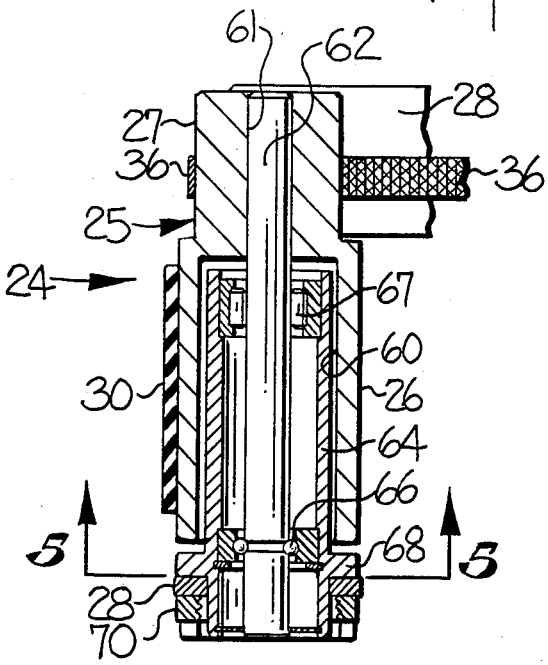
FIG. 4 is a fragmentary sectional view of the drive component of the apparatus and taken substantially along the line 4—4 of FIG. 1.

The structural features of the drive component 24 of the apparatus are illustrated in FIG. 4. The unitary tubular drive member 25 of the component comprises a first portion having a cylindrical outer surface defining the drive whorl 26, and a cylindrical bore 60. The member 25 also includes a second coaxial portion having a cylindrical outer surface defining the drive pulley 27, and a cylindrical bore 61. The diameters of the outer surface 26 and bore 60 of the first portion are greater than the diameters of the outer surface 27 and bore 61 of the second portion, respectively. A shaft 62 extends coaxially through the drive member, with the shaft having a diameter which generally corresponds to the diameter of the bore 61 of the second portion, so as to be fixed therein. The shaft 62 is thus spaced from the surface of the bore 60 of the first portion, and a coaxial mounting sleeve 64 is disposed between and spaced from each of the shaft 62 and the surface of the bore 60.

In addition, a pair of roller bearings 66, 67 are positioned between the shaft and internal bore of the sleeve.

Figure 5:
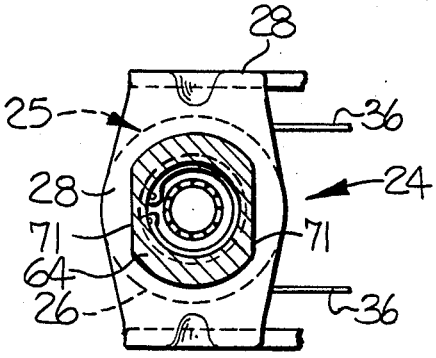
FIG. 5 is a sectional end view of the drive component and taken substantially along the line 5—5 of FIG. 4.

The sleeve 64 includes a mounting portion extending axially beyond the open end of the first portion of the drive member, and the mounting portion is releasably mounted in an aperture in the support bracket 28 by a structure which comprises a radial shoulder 68 integrally formed on the external surface of the mounting portion, an external screw thread formed on the surface of the sleeve adjacent the shoulder, and a nut 70 threadedly engaging the screw thread and adapted to cooperate with the shoulder 68 for clampingly engaging the apertured support bracket 28 therebetween. As seen in FIG. 5, the external surface of the sleeve includes a pair of flat chordal surfaces 71 disposed between the shoulder and nut, with the flat chordal surfaces 71 mating with corresponding surfaces in the aperture of the support bracket to prevent relative rotation therebetween.

As noted above, the discs 13 and 14 are mounted to the frame for rotation about parallel spaced apart axes. These axes are defined by the shafts 16 and 17, and are parallel to a central axis which is coincident to the axis of the piston 54 and the twisting zone 19. More particularly, the disc mounting means includes a pair of rocking arms 72, 73 which are pivotally mounted to the frame of the apparatus for selective pivotal movement about the central axis.

Figure 7:
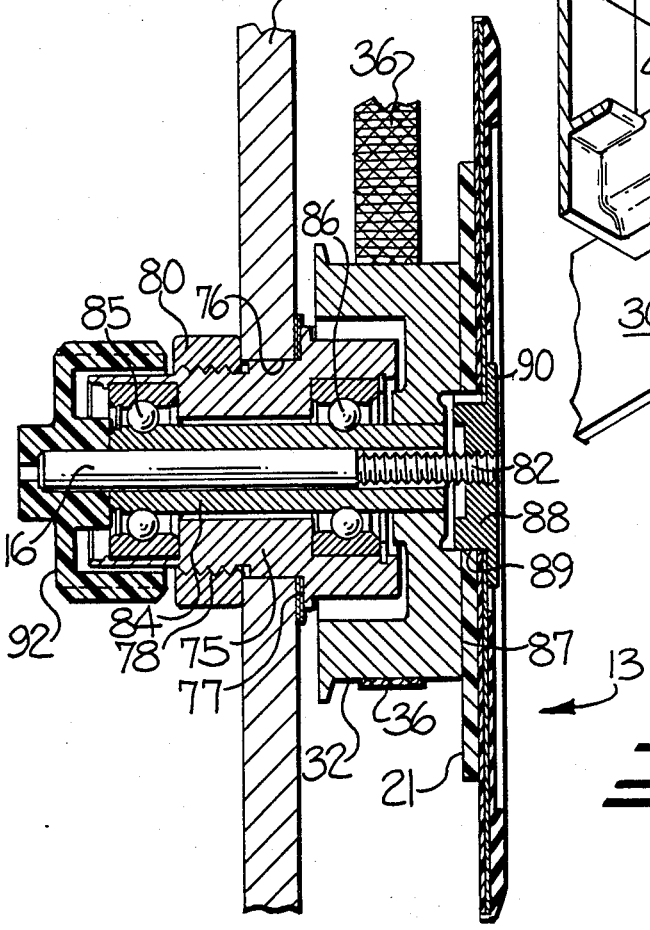
FIG. 7 is a sectional view of the bearing assembly for one of the twist imparting discs of the apparatus.

The discs 13 and 14 are rotatably mounted to respective ones of the rocking arms 72, 73 by means of the shafts 16 and 17 which are fixed to the discs. The bearing assemblies for rotatably mounting the shafts 16 and 17 to the associated rocking arms are identical, and the assembly for mounting the shaft 16 to the arm 72 is shown in FIG. 7. This assembly comprises a tubular sleeve 75 mounted in an aperture 76 of the rocking arm, and the sleeve includes an integral shoulder 77 positioned to engage the rocking arm on one side of the aperture. An external thread 78 is formed in the outer surface of the sleeve adjacent the shoulder, and a threaded nut 80 engages the external thread 78 of the sleeve and is positioned to clampingly engage the rocking arm between the nut and shoulder.

The shaft 16 extends coaxially through the sleeve 75 and includes a threaded end 82 disposed axially beyond one end of the sleeve, and an opposite end which extends axially beyond the other end of the sleeve. A tubular bushing 84 is disposed coaxially about the shaft 16 in a close fitting relationship, and the bushing extends along a substantial portion of the length of the shaft. The bushing 84 forms the inner race for two spaced apart ball bearings 85, 86, which rotatably support the bushing with respect to the sleeve. The bushing extends axially beyond the sleeve 75 at the end thereof which corresponds to the threaded end 82 of the shaft, and the drive pulley 32 is fixed to this end of the bushing. The drive pulley 32 in turn includes a planar end surface 87 disposed perpendicular to the axis of the shaft 16 and the bushing 84.

The disc 13 is mounted to the threaded end 82 of the shaft 16 by an arrangement which includes a cap 88 having a cylindrical external surface 89 with a flange 90 at the outer end thereof. The cap 88 includes a threaded aperture which receives the end 82 of the shaft, and the disc 13 includes an aperture mounted on the cylindrical external surface 89 of the cap and behind the flange 90. The back-up plate 21 is also mounted on the external cylindrical surface 89 of the cap behind the disc, and such that the plate 21 is disposed between the disc and the planar surface 87 of the drive pulley.

The end of the shaft 16 opposite the threaded end 82 fixedly mounts an exposed locking head 92 which is adapted to abut the adjacent end of the bushing 84 when the cap is threadedly tightened upon the shaft. Thus rotation of the locking head 92 relative to the cap 88 tends to press the disc 13, and back-up plate 21 against the planar surface 87 of the drive pulley 32, and upon complete tightening, the locking head 92, shaft 16, bushing 84, drive pulley 32, cap 88, and disc 13 are all concurrently rotable about the axis of the shaft and relative to the sleeve 75.

In the drawings and specification, there has been set forth a preferred embodiment of the invention, and although specific terms are employed, they are used in a generic and descriptive sense only and not for purposes of limitation.

That which is claimed is:

1. A bearing assembly adapted for rotatably mounting a yarn twist imparting member in a false twisting apparatus or the like, and comprising a tubular sleeve, means for releasably mounting said sleeve in an aperture of a frame support member or the like, a shaft extending coaxially through said sleeve and including one end disposed axially beyond said sleeve, means at said one end of said shaft for mounting a yarn twist imparting member or the like thereto, bearing means positioned between said shaft and sleeve for permitting relative rotation therebetween, said bearing means including a tubular bushing disposed coaxially about said shaft and extending along a substantial portion of the length thereof, and axially spaced apart bearings positioned between said bushing and said sleeve, said bushing extending axially beyond said sleeve at the end thereof adjacent said one end of said shaft, and a drive pulley fixed to the end of said bushing adjacent said one end of said shaft, with said drive pulley including a planar end surface disposed perpendicularly to the axis of said shaft and bushing.

2. The bearing assembly as defined in claim 1 wherein said means for releasably mounting said sleeve to a frame support member includes an integral external shoulder on said sleeve and positioned to engage the frame support member about one side of the aperture therein, an external thread formed in the outer surface of said sleeve adjacent the shoulder, and a nut threadedly engaging said external thread of said sleeve and adapted for clampingly engaging the frame support member between said nut and shoulder.

3. The bearing assembly as defined in claim 1 wherein said means at said one end of said shaft for mounting a yarn twist imparting member or the like thereto includes a cap having a cylindrical external surface and a radial flange at one end of said external surface, and cooperating thread means on said shaft and said cap for threadedly interconnecting the same, and whereby an apertured twist imparting member may be mounted on the cylindrical external surface of said cap and drawn into engagement with said planar end surface of said drive pulley by said thread means.

4. The bearing assembly as defined in claim 3 further comprising an exposed locking head fixedly mounted on the end of said shaft opposite said one end, with said locking head adapted for abutting the adjacent end of said bushing upon the cap being threadedly tightened upon said shaft, and whereby the locking head, shaft, bushing, drive pulley, and cap are adapted to concurrently rotate about the axis of said shaft and relative to said sleeve.

* * * * *